US006080941A

United States Patent [19]

Yokobori

[11] Patent Number: 6,080,941

[45] Date of Patent: Jun. 27, 2000

[54] MULTI-DIRECTIONAL KEY SWITCH ASSEMBLY

[75] Inventor: Syuuya Yokobori, Isesaki, Japan

[73] Assignee: Hosiden Corporation, Osaka, Japan

[21] Appl. No.: 09/192,587

[22] Filed: Nov. 17, 1998

[30] Foreign Application Priority Data

Nov. 26, 1997 [JP] Japan ..... 9-324056

[51] Int. Cl.[7] ..... H01H 25/04

[52] U.S. Cl. ..... 200/6 A; 200/4

[58] Field of Search ..... 200/1 B, 4, 6 A

[56] References Cited

U.S. PATENT DOCUMENTS

| | | | |
|---|---|---|---|
| 5,621,196 | 4/1997 | Nishijima et al. | 200/6 A |
| 5,691,517 | 11/1997 | Yamamoto et al. | 200/6 A |
| 5,719,361 | 2/1998 | Lee | 200/1 B |
| 5,847,335 | 12/1998 | Sugahara et al. | 200/4 |

FOREIGN PATENT DOCUMENTS 1102546 2/1968 United Kingdom .

*Primary Examiner*—Renee Luebke

*Attorney, Agent, or Firm*—Pollock, Vande Sande & Amernick

[57] ABSTRACT

A multi-directional key switch assembly comprises first stage switches and second stage switches of different kinds disposed alternately arrayed at 45° on a common circle at angular intervals on a printed-circuit board, a truncated semi-spherical shell shaped rolling member disposed on the board in overlying relation to thee switches, slide members disposed on the undersurface of the semi-spherical shell shaped rolling member in opposition to the corresponding first stage switches, and actuating means disposed in correspondence with the second stage switches. A key top is mounted on the rolling member and has an integral operating stick extending from the undersurface thereof. The operating stick is inserted in a receiving bore formed through the rolling member from the upper surface to the undersurface thereof along the central axis thereof. Rolling the rolling member by pressing on the key top will cause the corresponding first stage switch to be turned ON, and further continued rolling of the rolling member will actuate the corresponding second switch to turn it ON.

14 Claims, 13 Drawing Sheets

MULTI-DIRECTIONAL KEY SWITCH ASSEMBLY

BACKGROUND OF THE INVENTION

This invention relates to a multi-directional key switch assembly having a central switch, and, more particularly, to a multi-directional key switch assembly useful for depressing a plurality of different kinds of switches and maintaining them simultaneously in an ON-state.

A typical example of the prior art multi-directional key switch assembly, as shown in a cross-sectional view in FIG. 1, comprises a central switch 77 and a plurality of peripheral switches 79 arrayed on a circle around the central switch and each including a fixed contact pair, all the switches being disposed on a printed-circuit board 80, as disclosed in Japanese Patent Publications Kokai Nos. 7-141962 and 7-141963, for example. This multi-directional key switch assembly is configured such that the central switch 77 may be actuated by depressing the key top 72 downwardly and that any one or more of the peripheral switches 79 may be actuated by tilting the key top 72 radially outwardly.

While this prior art multi-directional key switch assembly is configured such that the central switch 77 may be actuated by depressing the key top 72 downwardly and that a plurality of the peripheral switches 79 may be actuated by pressing and tilting the key top 72 radially outwardly, it has only two kinds of switches, the central switch 77 and the plurality of peripheral switches 79 circumferentially arranged around and outward of the central switch. While these peripheral switches 79 are differentiated from each other by the directions in which the key top 72 is tilted for actuation, it may be said that they are in the same rank and the same kind.

Another example of the prior art multi-directional key switch assembly, the arrangement of fixed contacts of which is shown in a plan view in FIG. 2A, comprises an up-to-down array of linearly aligned switches each including a fixed contact pair 20u1, 20u2, 20u3, 20d1, 20d2, 20d3 and a left-to-right array of linearly aligned switches each including a fixed contact pair 20l1, 20l2, 20l3, 20r1, 20r2, 20r3. As shown in FIG. 2B, these switches are accommodated in a case 12 and are adapted to be operated by a criss-cross key top 14 having operating tabs 14u, 14d, 14l and 14r. The arrangement is such that the key top 14 may be tilted in a desired direction and at an angle of desired degrees by press-operating the operating tabs 14u, 14d, 14l, 14r whereby one or more of the plurality of switches may be succesively turned ON and maintained in that ON-state depending on the direction and the degree of angle of tilting. Such multi-directional key switch assembly is disclosed in Japanese Patent Publication Kokai No. 2-41342, for example.

In this prior art switch assembly the fixed contact pairs 20u1, 20d1, 20l1 and 20r1 arrayed on the same circle constitute a group of the same kind of switches. Likewise, the fixed contact pairs 20u2, 20d2, 20l2 and 20r2 arrayed on the same circle constitute a second group of the same kind of switches. And the fixed contact pairs 20u3, 20d3, 20l3 and 20r3 arrayed on the same circle constitute a third group of the same kind of switches. It will thus be understood that a group of switches belonging to the same kind are common to all in that the degree of angle to which the key top 14 is required to be tilted to actuate the switches.

A wide variety of multi-directional key switch assemblies other than those as described above have been developed and are in use.

In the prior art example illustrated in FIG. 1, excluding the central switch 77, as for the kind of switch, there is only one kind of switch, that is, the peripheral switches 79 which require the same angle of tilting of the key top 72 to effect the ON-actuation. In order to form another kind of switch having a different nature in addition to the peripheral switches 79, it is required that an additional array of switches be arranged on a circle outward of the peripheral switches, which necessitates enlarging the entire switch structure in its outer diameter. Representative of such example is the prior art key switch assembly shown in FIGS. 2A and 2B comprising three kinds of switches having different natures. However, since these three kinds of switches are formed on three different circles, it can hardly be said that such an arrangement has a good space factor.

SUMMARY OF THE INVENTION

It is an object of this invention to provide a multi-directional key switch assembly capable of selectively actuating different kinds of switches, without the need for significantly enlarging the assembly in its outer diameter.

The multi-directional key switch assembly according to this invention comprises:

- a substrate board means having disposed thereon first fixed contacts and second fixed contacts for a plurality of first stage switches and a plurality of second stage switches of a different kind than that of said first stage switches, respectively, said first fixed contacts and second fixed contacts being alternately arrayed on a common circle;
- first and second movable contacts disposed in opposition to said corresponding first and second fixed contacts and being cooperative with the first and second fixed contacts to define said first stage and second stage switches, respectively;
- a rolling means having first and second actuating means disposed in overlying relation to said first and second movable contacts, respectively, said first and second actuating means being operative in response to external forces applied in a desired direction about the center of said common circle to actuate corresponding one or more of said first stage and second stage switches; and
- a key top mounted on said rolling means and adapted in response to external forces applied to said key top to roll said rolling means, whereby rolling said rolling means in any desired direction will cause the corresponding first stage switch or switches to be turned ON, and further continued rolling of said rolling means in the same direction will actuate the corresponding second switch or switches to turn it or them ON.

DETAILED DESCRIPTION OF THE PREFERRED EMBODIMENTS

This invention will be described with reference to the embodiment shown in the accompanying drawings.

Figure 1:
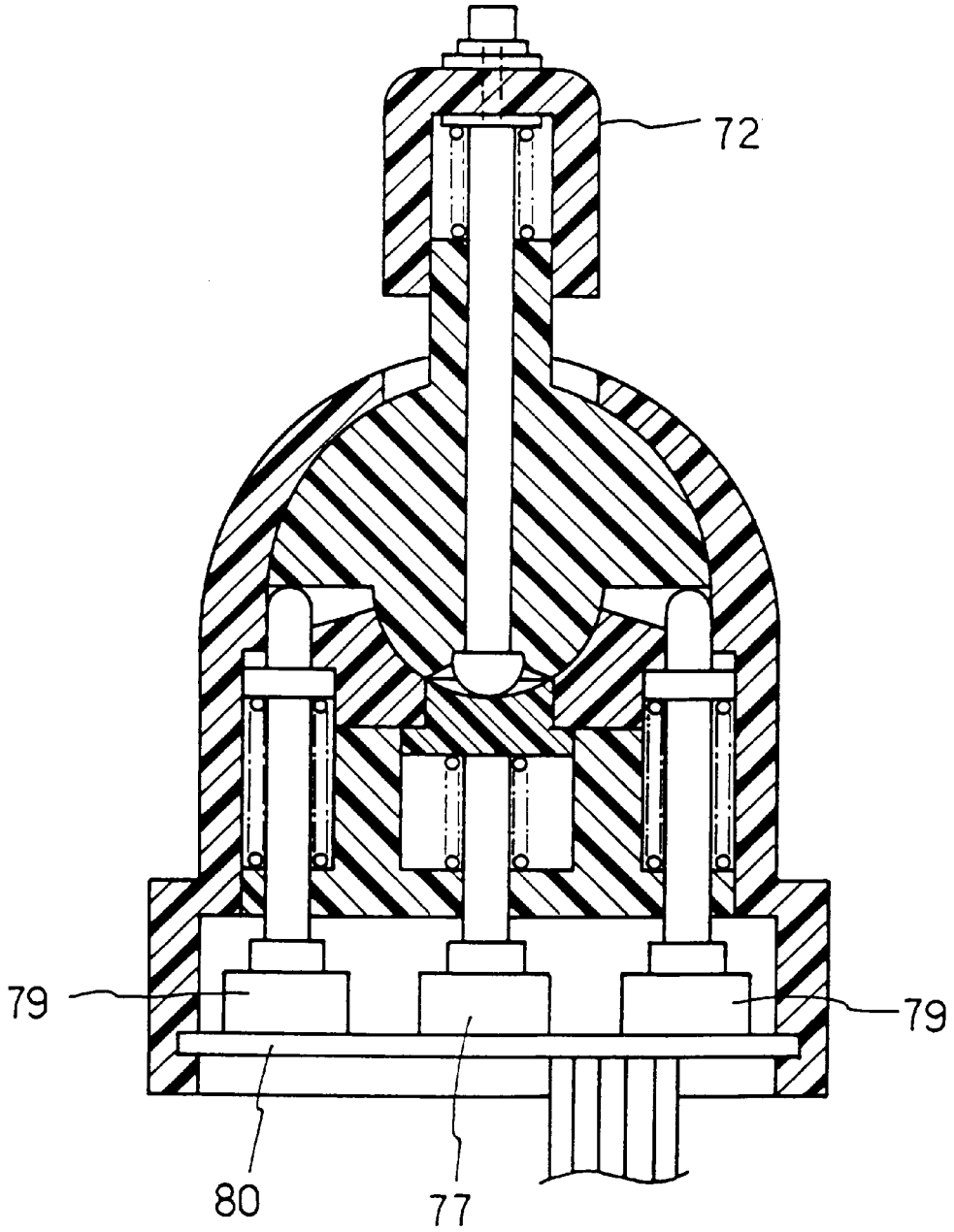
FIG. 1 PRIOR ART
FIG. 1 is a representation illustrating a prior art example.
Figure 2A:
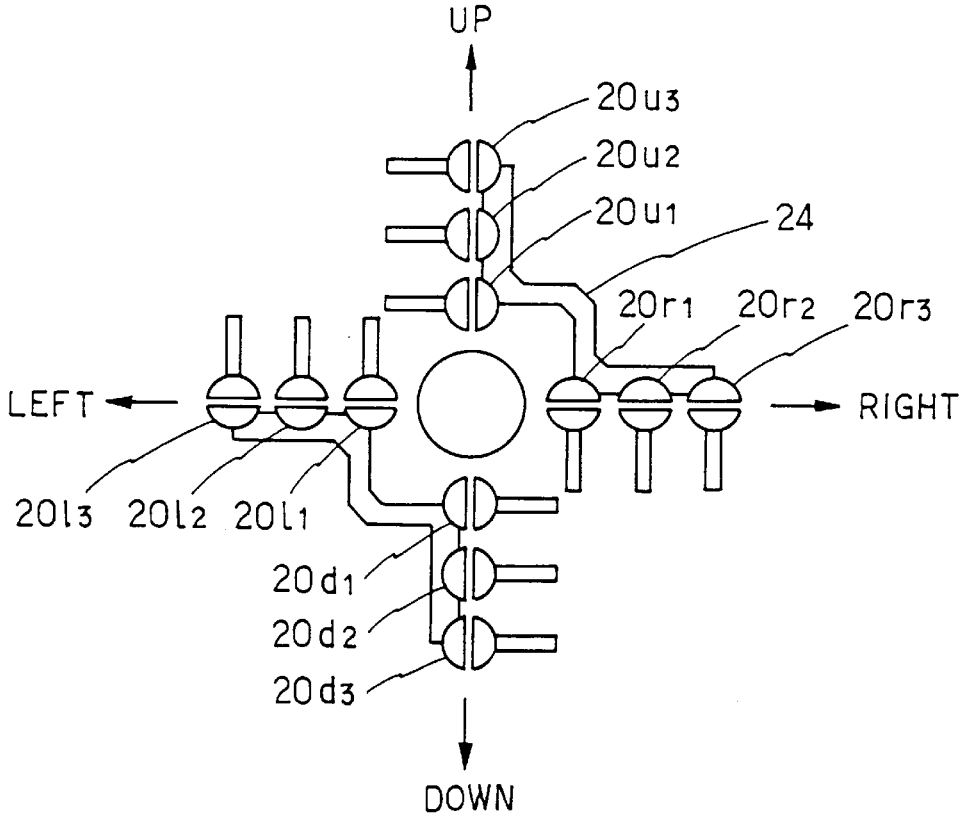
FIG. 2A PRIOR ART
FIG. 2A is a plan view illustrating arrays of fixed contacts in another prior art example.
Figure 2B:
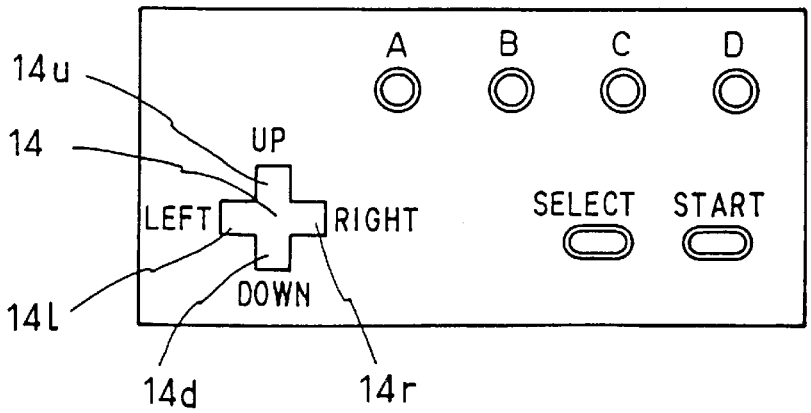
FIG. 2B PRIOR ART
FIG. 2B is a plan view of a case for housing a switch assembly utilizing the fixed contacts shown in FIG. 2A.
Figure 3:
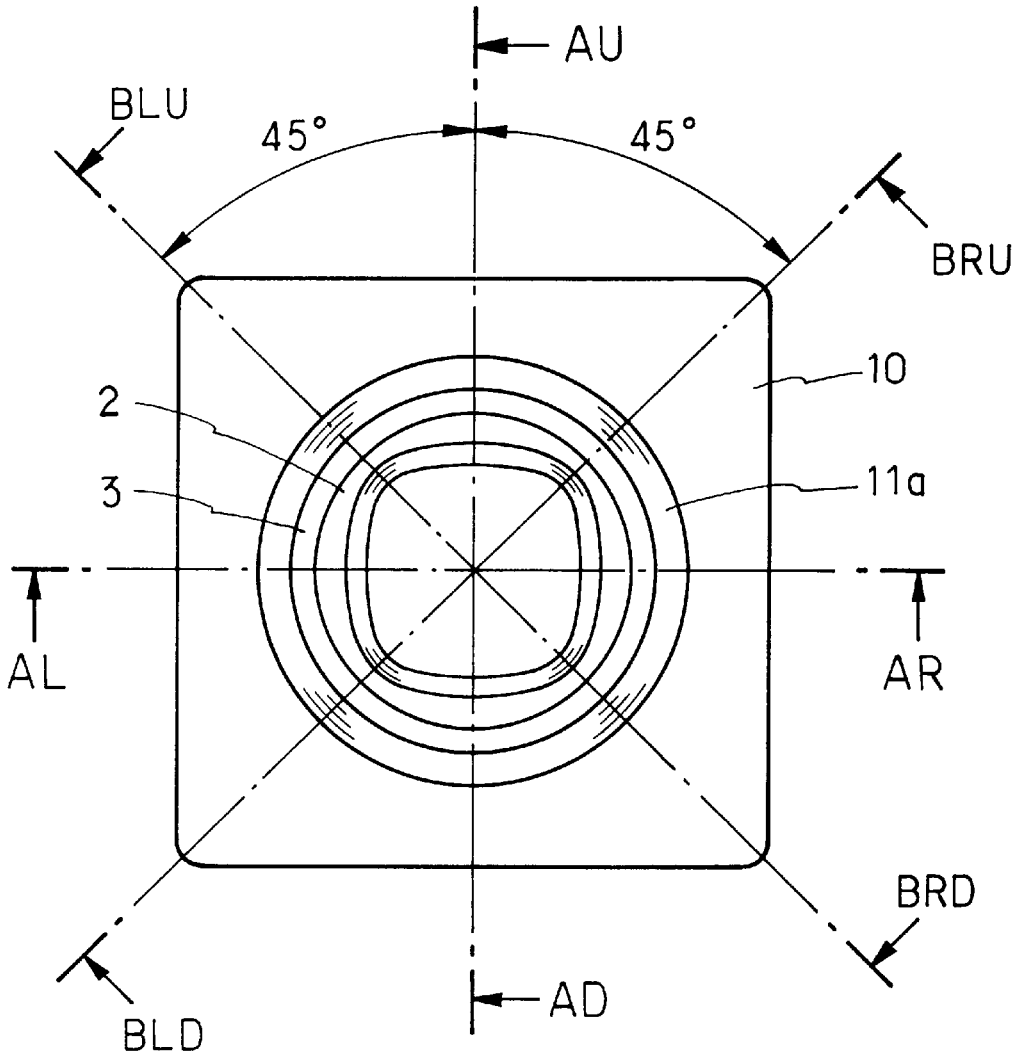
FIG. 3 is a plan view illustrating an embodiment of the multi-directional key switch assembly according to this invention.

Referring first to FIG. 3, the embodiment of the multi-directional key switch assembly according to this invention will be conceptually described. FIG. 3 is a top plan view illustrating the multi-directional key switch assembly according to an embodiment of this invention. Shown generally at 10 is a rectangular housing molded of synthetic resin which has a switch receiving opening 11*a* formed therethrough. A key top designated at 2 is made of synthetic resin for press-operating a plurality of switches belonging to different kinds. An up-to-down (referred to a first diametrical direction) extending line and a left-to-right (referred to a second diametrical direction) extending line are indicated by AU-AD and 5—5, respectively. Likewise, a right up-to-left down (referred to a third diametrical direction) extending line and a left up-to-right down (referred to a fourth diametrical direction) extending line defining an angle of 45° with respect to the up-to-down extending line and the left-to-right extending line, respectively are indicated by 6—6 and BLU-BRD, respectively.

Figure 4:
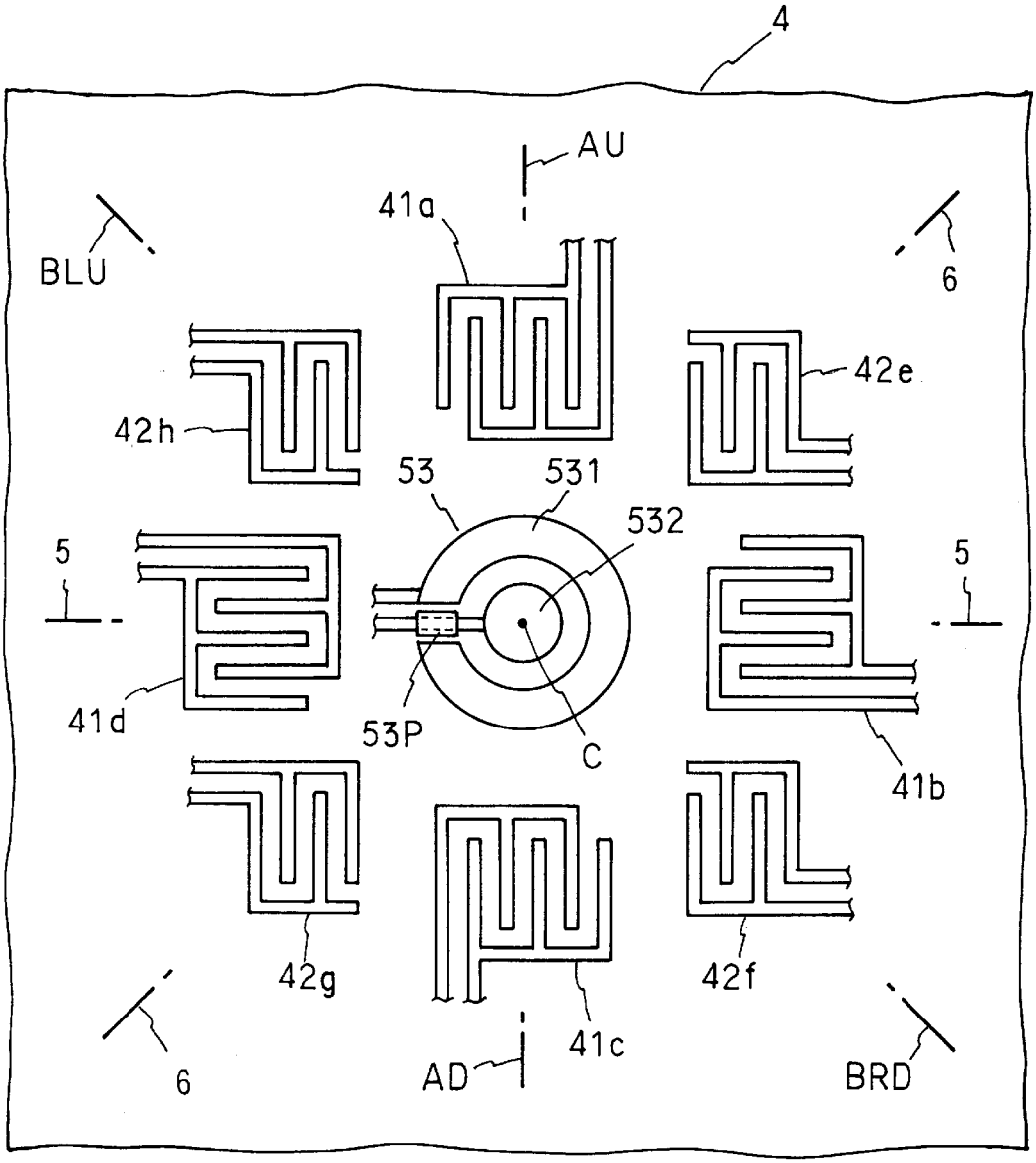
FIG. 4 is a plan view illustrating the array of fixed contacts in the multi-directional key switch assembly.
Figure 5:
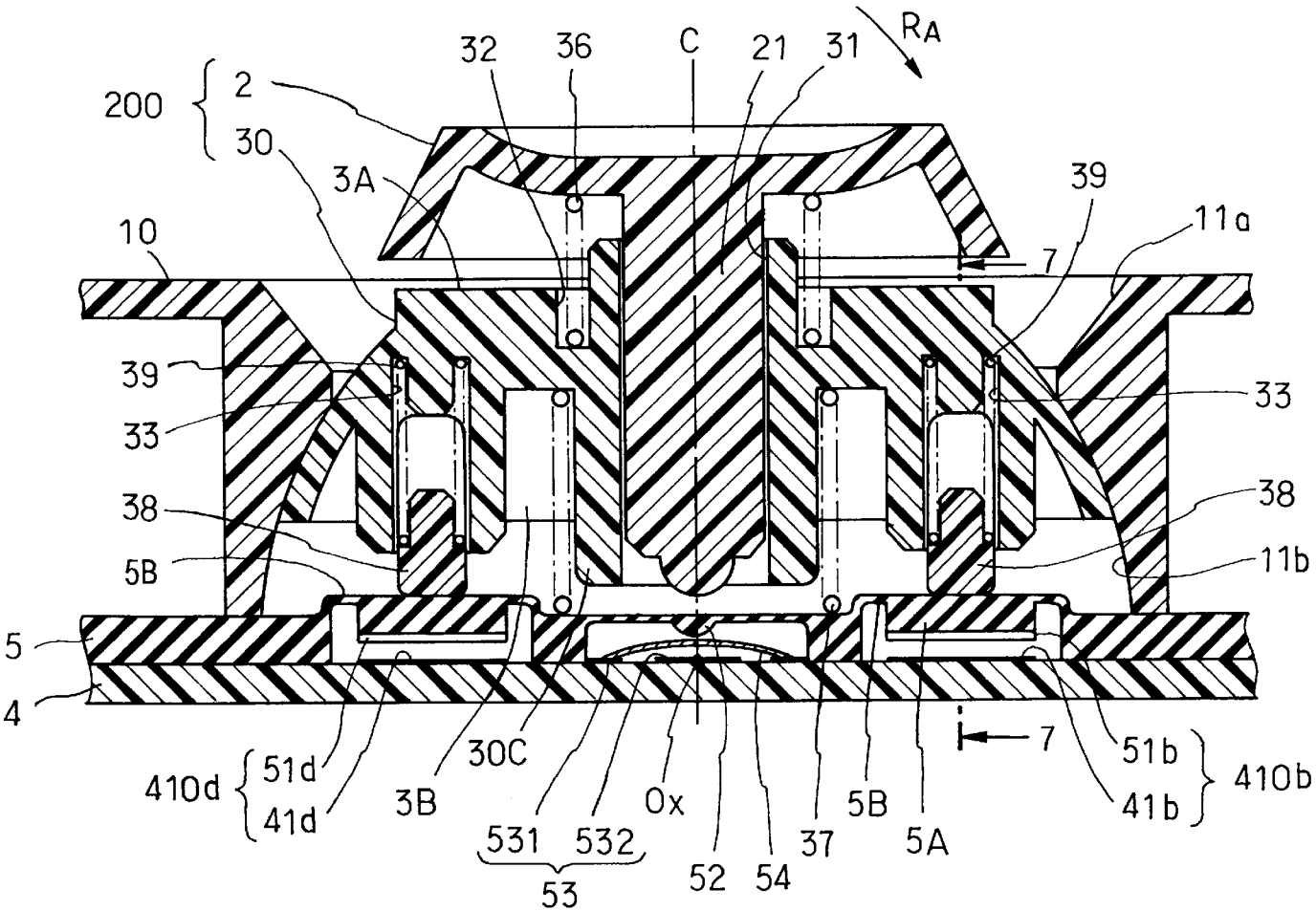
FIG. 5 is a cross-sectional view taken on line 5—5 in FIG. 3.
Figure 6:
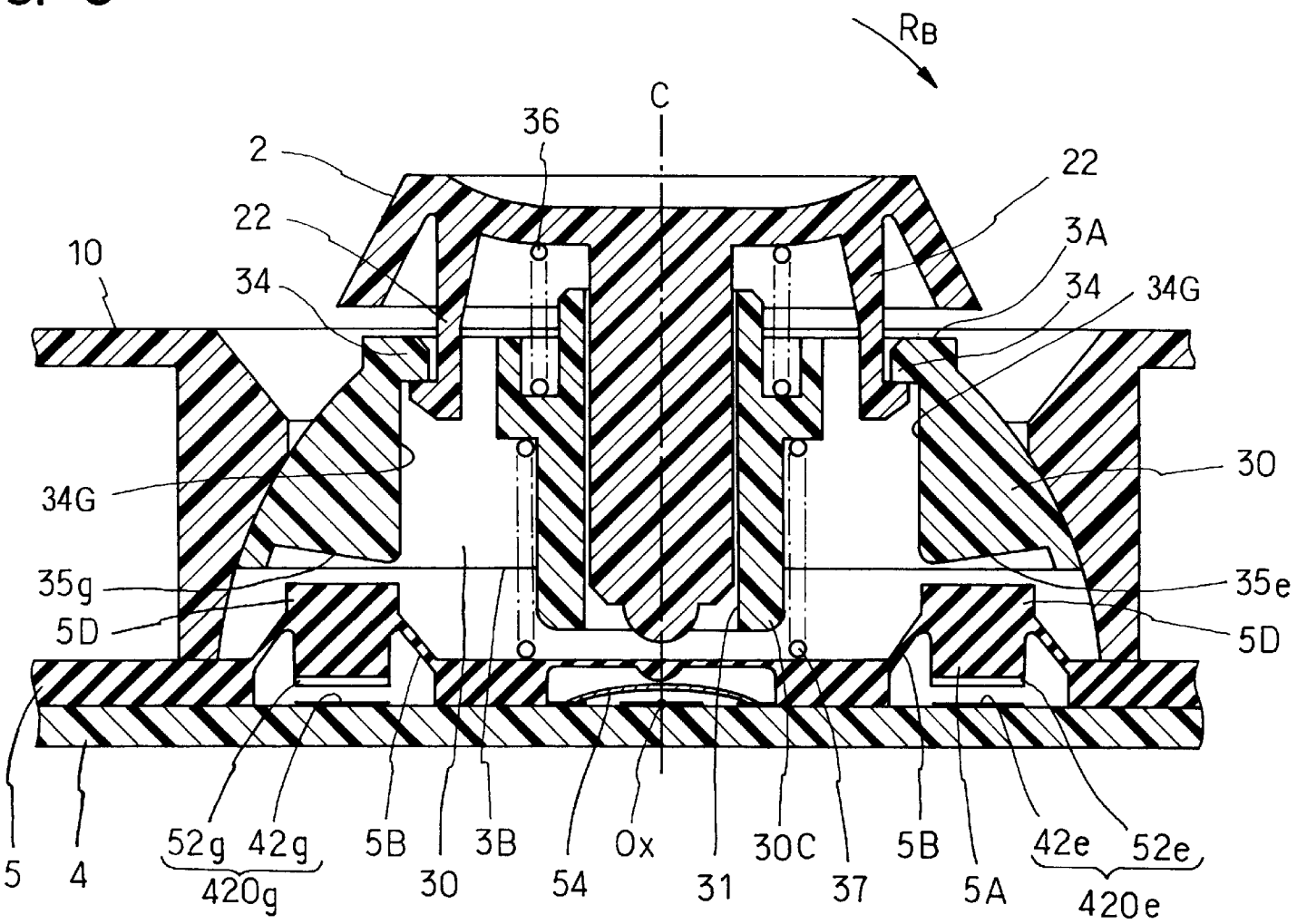
FIG. 6 is a cross-sectional view taken on line 6—6 in FIG. 3.

Now referring to FIGS. 4, 5 and 6, disposed in the housing 10 is a central fixed contact pair 53 comprising a C-shaped outer electrode 531 and an inner circular electrode 532 both formed on a printed-circuit board 4. A lead wire from the circular electrode 532 is drawn through a slit in the C-shaped electrode 531. That portion of the lead wire extending through the slit is coated with an insulation film 53P. Further, vertically formed on the printed-circuit board 4 are fixed contacts 41 a and 41 c which are located symmetrically about a central axis C passing through the center of the circular electrode 532 and in opposed relation to each other along the first diametrical direction AU-AD. Also formed along the second diametrical direction 5—5 perpendicular to the first diametrical direction AU-AD are fixed contacts 41*d* and 41*b* in opposed relation to each other. Additionally disposed in the housing 10 are fixed contact 42*g* and 42*e* formed on the printed-circuit board 4 and located symmetrically about the central axis C of the housing 10 in opposed relation to each other along the third diametrical direction BRU-SLD defining an angle of 45° with respect to the first and second diametrical directions. Also formed along the fourth diametrical direction BLU-BRD defining an angle of 90° with respect to the third diametrical direction are fixed contacts 42*h* and 42*f* in opposed relation to each other.

Each of the fixed contacts 41*a*–41*d* and 42*e*–42*h* comprises a pair of interdigited comb-shaped electrodes. The switches having the fixed contacts 41*a,* 41*c* and 41*d,* 41*b* positioned along the first diametrical direction AU-AD and the second diametrical direction 5—5, respectively are herein referred to as the first stage switches, and the switches having the fixed contacts 42*g,* 42*e* and 42*h,* 42*f* positioned along the third diametrical direction 6—6 and the fourth diametrical direction BLU-BRD, respectively are referred to as the second stage switches. The fixed contacts 41*a,* 41*c,* 41*d,* 41*b* and the fixed contacts 42*g,* 42*e,* 42*h,* 42*f* for these two kinds of switches lie generally in the same circular annulus about the central axis C.

With reference to FIGS. 5 and 6, FIG. 5 is a cross-sectional view of the multi-directional key switch assembly according to this invention taken along the line AL-AR and viewed in the direction indicated by the arrows in FIG. 3 while FIG. 6 is a cross-sectional view of the assembly taken along the line 6—6 and viewed in the direction indicated by the arrows in FIG. 3.

In FIG. 5, the housing 10 has a semi-spherical inner slide wall surface 11*b* terminating in the upper switch receiving opening 11*a* having a conical tapered surface increasing in diameter toward the top. The key top 2 of the multi-directional key switch assembly has an integral operating stick 21 extending vertically downwardly from the center of the undersurface thereof. The key top 2 further has a first pair of engagement pieces 22 (FIG. 6) depending from the undersurface thereof on the line 6—6 symmetrically about the central axis C and a second pair of similar engagement pieces, not shown, depending from the undersurface on the line BLU-BRD.

Shown at 30 is a generally truncated semi-spherical shell functioning as a rocking or rolling means in sliding contact with the semi-spherical inner slide wall surface 11*b*. The semi-spherical shell shaped rocking member 30 has a generally flat top surface 3A and a bottom surface 3B having an integral cylindrical sleeve portion 30C extending concentrically with the central axis C downwardly from the center thereof. The axial bearing bore of the cylindrical sleeve portion 30C extends up through the top surface 3A of the rocking member 30 to define an operating stick receiving bore 31. The top surface 3A of the semi-spherical shell shaped rocking member 30 is formed with an annular groove 32 surrounding the cylindrical sleeve portion 30C. Extending up into the bottom surface 3B of the semi-spherical shell shaped rocking member 30 radially midway between the cylindrical sleeve portion 30C and the outer peripheral edge of the bottom surface 3B are slide member receiving bores 33 located symmetrically about the central axis C.

Mounted in each of the slide member receiving bores 33 is a first stage switch actuating means 350 comprising a slide member 38 and an associated slide member stroke producing spring 39 as will be later described with reference to FIGS. 7A and 7B. In addition, as shown in FIG. 6, guide grooves 34G extend through the semi-spherical shell shaped rocking member 30 from the top surface 3A and to and through the bottom surface 3B on the two orthogonal lines 6—6 and BRU-BLD, and the radially outward inner wall portion of each of the guide grooves 34G adjacent the top surface 3A projects radially inwardly so as to narrow the opening of the guide groove 34G to define an engagement portion 34. In addition, the inner wall of the semi-spherical shell shaped rocking member 30 has protrusions 35*e* and 35*g* extending from its lower end inwardly along the line BLD-BRU which are adapted to press down on the top surfaces of the corresponding movable roof portions 5A of domes 5D formed integral with a rubber resilient sheet 5 as will be described later in details. The protrusions 35*e*, 35*g* comprise a second stage switch actuating means for actuating second stage switches 420*g* and 420*e*. The semi-spherical shell shaped rocking member 30 and the key top 2 constitute a press-operating key 200.

On the upper surface of the printed-circuit board 4 forming part of the multi-directional key switch assembly there are first stage switches 410*a*, 410*b*, 410*c* and 410*d* formed and arranged at 90° angular intervals symmetrically about the central axis C in corresponding opposition to the respective fixed contacts 41*a*, 41*b*, 41*c* and 41*d* shown in FIG. 4. In FIG. 5 only the switches 410*b* and 410*d* are shown, but the switches 410*a* and 410*c* are not. In the following disclosure, any one of these first stage switches will be representatively called merely switch 410. Likewise, on the upper surface of the printed-circuit board 4, second stage switches 420*e*–420*h* are formed in corresponding opposition to the respective fixed contacts 42*e*, 42*f*, 42*g* and 42*h* shown in FIG. 4 at 45° offset from the respective first stage switches 410*a*–410*d* about the central axis C. In the following disclosure, any one of these second stage switches will be representatively called merely switch 420. These first stage switches 410*a*–410*d* and 420*e*–420*h* lie generally in the same circular annulus.

As shown in FIG. 5, the rubber resilient sheet 5 is formed in its undersurface with void spaces so located and sized as to enclose the respective fixed contacts 41*a*, 41*b*, 41*c* and 41*d*. The movable roofportions 5A are formed integral with the rubber resilient sheet 5 by means of thinned hinges 5B surrounding the respective roof portions so as to define the upper walls of the void spaces. The movable roof portions 5A have movable contacts 51*a*, 51*c* and 51*d*, 51*b* formed in its undersurface in opposition to the corresponding fixed contacts 41*a*, 41*b*, 41*c* and 41*d*. When any of the movable roof portions 5A are pressed down by downward pressure applied to the top surface thereof by means of the slide member 38, the associated movable contact, say the movable contact 51*b*, is brought into contact with the fixed contact 41*b* to thereby short-circuit the paired comb-like electrodes comprising the fixed contact 41*b* and hence to turn the first stage switch ON.

Referring to FIG. 6, the rubber resilient sheet 5 has the domes 5D formed integral therewith and so located and sized as to enclose the respective fixed contacts 42*e*–42*h* on the printed-circuit board 4 in correspondence with the respective second stage switches. Each of the domes 5D is frusto-conical and has a thickened movable roof portion 5A surrounded by a thinned peripheral wall 5B. The movable roof portions 5A have movable contacts such as those shown at 52*e*, 52*g* formed in its undersurface in spaced opposition to the corresponding fixed contacts such as those shown at 42*e*, 42*g*. When any of the movable roof portions 5A is pressed down by downward pressure applied to the top surface thereof by means of the associated protrusion 35*e* or 35*g* of the second stage switch actuating means, the peripheral wall 5B is resiliently flexed. When the pressure force exceeds a certain level, the upper half portion of the peripheral wall 5B is folded inwardly under the lower half portion of the peripheral wall, so that the operator may feel a click. When this occurs, the movable contact 52*e*, for example comes into contact with the associated fixed contact 42*e*, whereby the paired comb-like electrodes comprising the fixed contact 42*e* is short-circuited to turn the second stage switch ON.

It will thus be appreciated that the first stage switches 410 are configured not to provide any clicking feeling whereas the second stage switches 420 only are configured so as to provide a clicking feeling, whereby the operator may clearly perceive or feel that the first stage switch 410 has first been actuated, followed by the second stage switch 420 being actuated while the first stage switch is maintained energized.

In FIGS. 5 and 6, a central switch is shown at 430. The central switch 430 consists of a central fixed contact 53 comprising a C-shaped outer electrode 531 and an inner circular electrode 532 disposed within the outer electrode, both print-formed on the upper surface of the printed-circuit board 4 in the center thereof, and a central movable contact in the form of a snap plate 54 made of a thin resilient metallic material having an upwardly convex spherical surface and resting around its outer periphery on the C-shaped outer electrode 531. A lead wire from the circular electrode 532 is drawn out through a slit in the C-shaped electrode 531. That portion of the lead wire extending through the slit is coated with an insulation film 53P to prevent the periphery of the snap plate 54 from short-circuiting the C-shaped electrode 531 and the lead wire of the circular electrode 532. The resilient sheet 5 is formed in its undersurface with a recess so located and sized as to define a volume enclosing the central fixed contact 53 and the central movable contact 54, and the thin movable roof portion 5C defining the ceiling of the recess has an integral projection 52 extending downwardly from the undersurface of the roof portion in the center thereof in opposition to the apex of the movable contact 54. When the central movable contact, that is the snap plate 54 is pressed down by the operating stick 21 by means of the projection 52 of the movable roof portion 5C, the central portion of the snap plate 54 is click-inverted into touch with the circular electrode 532 to short-circuit the C-shaped electrode 531 and the circular electrode 532. The central switch 430 may be a metal tact switch, a click-invertable switch or any other suitable switch.

A key top biasing coil spring 36 has its lower end inserted in the annular groove 32 in the top surface 3A of the semi-spherical shell shaped rocking member 30 and its upper end abutting against the undersurface of the key top 2 to normally bias the latter upwardly. The engagement pieces 22 depending integrally from the undersurface of the key top 2 are in engagement with the engagement portion 34 of the semi-spherical shell shaped rocking member 30 to prevent dislodgement of the key top 2. A rocking member biasing coil spring 37 is mounted around the cylindrical sleeve portion 30C with its lower end protruding downward beyond the sleeve portion 30C into abutment with the upper surface of the resilient sheet 5 and its upper end in abutment with the inner surface of the ceiling of the semi-spherical shell shaped rocking member 30 to normally bias the latter upwardly so that the outer spherical surface of the rocking member 30 is urged against the spherical guide surface 12*b* of the housing 10. In this condition, the rocking member 30 is rotatable with its outer semi-spherical surface in sliding contact with the spherical guide surface 12*b*.

A light downward pressure applied on the periphery of the rocking member 30 causes the latter to roll to turn one or two adjacent ones of the first stage switches, but the biasing force of the key top biasing coil spring 36 is adjusted such that the central switch 430 is not turned ON in response to such light pressure. In addition, the biasing force of the rocking member biasing coil spring 37 is made sufficiently greater than that of the key top biasing coil spring 36 that a vertically downward pressure applied on the center of the key top 2 causes the operating stick 21 of the key top 2 to be displaced downward against the biasing force of the key top biasing coil spring 36 to turn the central switch 430 ON while the rocking member 30 is maintained in contact with the semi-spherical inner slide wall surface 11*b*.

Figure 7A:
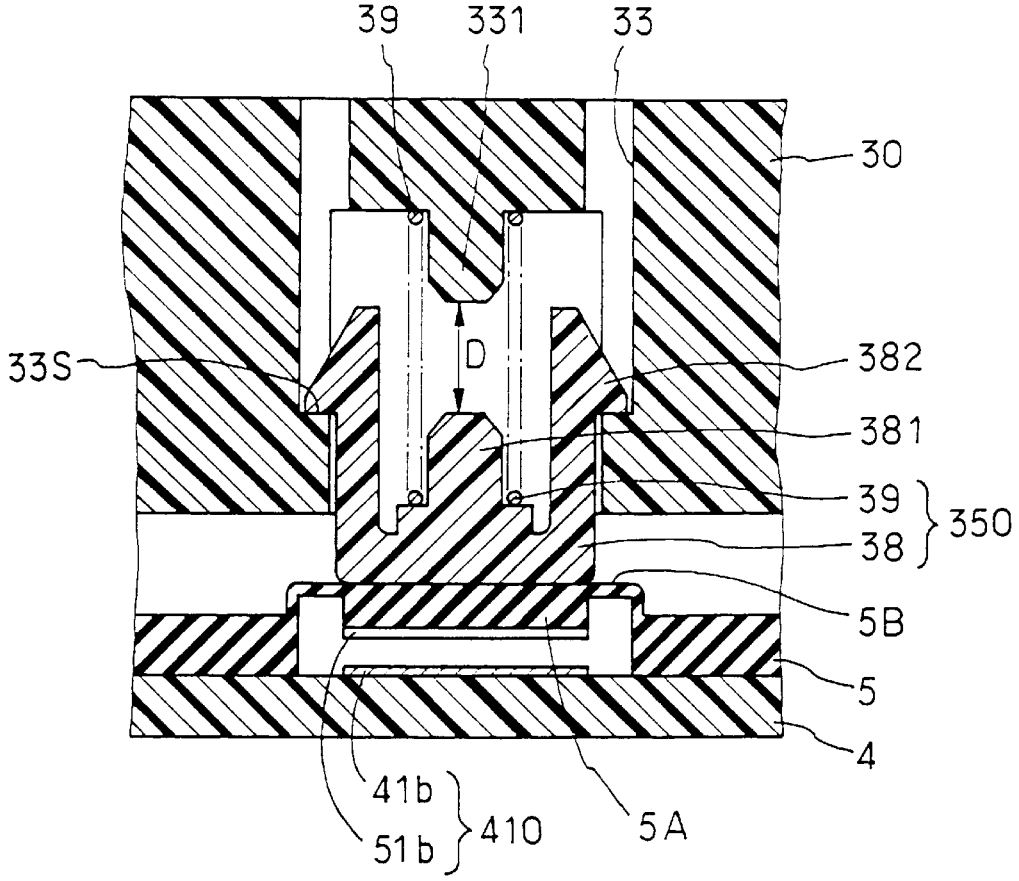
FIG. 7A is a cross-sectional view taken on line 7—7 in FIG. 5.
Figure 7B:
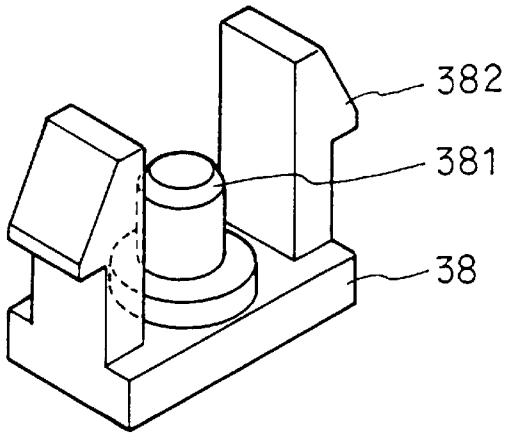
FIG. 7B is a perspective view of the slide member.

FIG. 7A is a cross-sectional view of the slide member receiving bore 33 taken on line 7—7 in FIG. 5 and viewed in the direction indicated by the arrows. The slide member stroke producing spring 39 is disposed in the receiving bore 33 between a boss 331 protruding downwardly form the center of the ceiling of the receiving bore and an opposed boss 381 extending upwardly from the center of the upper surface of the slide member 38 to bias the slide member 38 downwardly. As shown in FIG. 7B, the slide member 38 has integral engagement prongs 382 upstanding therefrom on the opposite sides of the boss 381, which engagement prongs 382 are hooked on shoulders 33S formed in the walls of the receiving bores 33 to prevent dislocation of the slide member 38. The slide member 38 is normally (neutral condition) in its lowermost position with its engagement prongs 382 resting on the shoulders 33S. In this state, the undersurface of the slide member 38 is nearly in contact with the upper surface of the movable roof portion 5A of the resilient sheet 5. It is thus to be understood that rolling the swing member 30 even slightly will cause the slide member 38 to displace the movable roof portion 5A downwardly.

The hinge portion 5B joining the movable roof portion 5A with the body of the resilient sheet 5 is so thinned in thickness that it is subject to elastic deformation under even much less force as compared to the biasing force of the spring 39. Consequently, when the operating stick 21 is tilted so as to lower the side of the key top corresponding to the first stage switch 410, the undersurface of the slide member 38 is lowered to displace the movable roof portion 5A downwardly. Displacing the movable roof portion 5A downwardly by a distance corresponding to a gap between the fixed contact 41*b* and the movable contact 51*b*. The gap may be on the order of 1 mm, for example.

Figure 8:
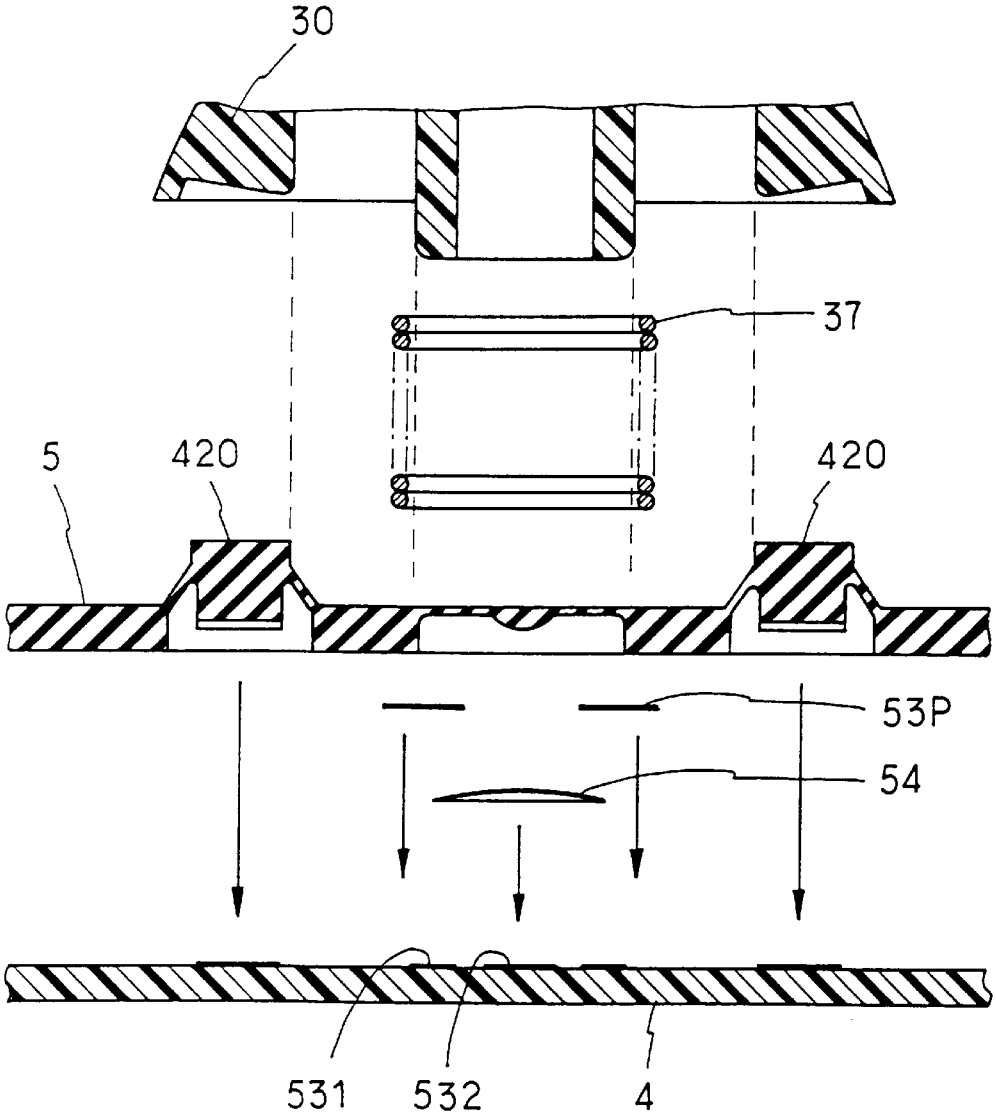
FIG. 8 illustrates how to assemble the multi-directional key switch assembly according to the embodiment.

In the embodiment of the switch according to this invention, if the rocking member 30 is rolled in the same direction farther from the position in which the first stage switch is turned ON, the slide member 38 is pushed deeper into the receiving bore 33 against the force of the spring 39 to thereby turn the second stage switch ON. In this regard, it should be noted that the maximum distance D between the lower end of the boss 331 protruding form the rocking member 30 and the upper end of the opposed boss 381 extending from the slide member 38 as shown in FIG. 7B is selected to be greater than the distance of travel through which the boss 331 is moved downwardly from the position (shown in FIG. 10) where only the first stage switch 410 is turned ON with the slide member 38 extended farthest down out of the receiving bore 33 to the position (shown in FIG. 13) where the second stage switch 420 is turned ON. In addition, as shown in FIG. 8, the spacing between the lower end of the actuating means 35*e* (35*g*) and the top surface of the dome 5D is selected such that the actuating means 35*e* is kept out of abutment with the dome 5D until the rocking member 30 is rolled to turn the first stage switch 410 ON. Specifically, the distance between the lower end of the actuating means 35*e* in its neutral position and the top surface of the dome 5D and the distance between the boss 381 of the slide member 38 and the boss 331 of the rocking member 30 are selected such that the minimum tilt angle $\theta_2$ (FIGS. 10 and 12) required of the operating stick 21 to turn ON the first stage switches is smaller than the minimum tilt angle h2 (FIGS. 11 and 13) required of the operating stick 21 to turn ON the second stage switches lying on the same circle as the first stage switches (that is, $\theta_2<\theta_2$).

Figure 9:
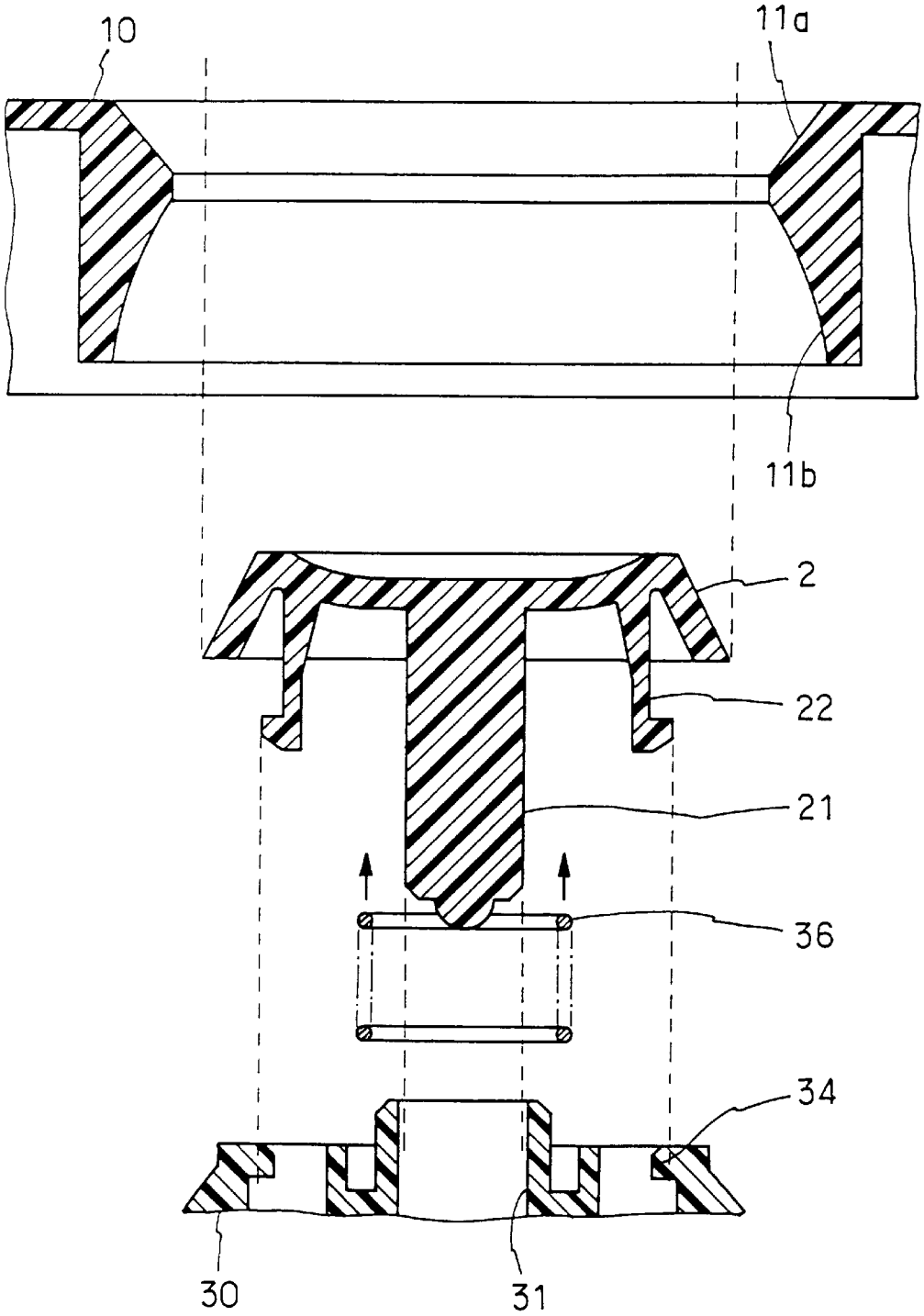
FIG. 9 fturther illustrates how to assemble the multi-directional key switch assembly according to the embodiment.

Next, the procedures for assembling the multi-directional key switch assembly will be described with reference to FIGS. 8 and 9. A central movable contact 54 as shown in FIG. 8 is disposed at a predetermined position on a printed-circuit board 4 having printed therein fixed contacts 41 and a central fixed contact 53 as shown in FIG. 4 and wiring (not shown) connected with those contacts. An annular, thin, retaining insulation film 53P is laid over the central movable contact 54 to cover the periphery of the contact, followed by bonding a rubber resilient sheet 5 to the printed-circuit board 4. A rocking member biasing coil spring 37 is disposed on the rubber resilient sheet 5 at a position corresponding to the central fixed contact 53. Slide members 38 and slide member stroke producing springs 39 are assembled into slide member receiving bores 33 (FIG. 5) in a semi-spherical shell shaped rocking member 30. The cylindrical sleeve portion 30C of the semi-spherical shell shaped rocking member 30 is inserted into the rocking member biasing coil spring 37 while the semi-spherical shell shaped rocking member 30 is positioned on the rubber resilient sheet 5 with the slide member receiving bores 33 overlying the corresponding first stage switches 410. As shown in FIG. 9, a key top biasing coil spring 36 is fitted into the annular groove 32 of the semi-spherical shell shaped rocking member 30. Then, the operating stick 21 of a key top 2 is inserted into operating stick receiving bore 31 against the force of the key top biasing coil spring 36 as the engagement pieces 22 of the key top are the respective engagement portions 34 of the semi-spherical shell shaped rocking member 30. Finally, a housing 10 is secured to the printed-circuit board 4 with the semi-spherical inner slide wall surface 11*b* of the housing abutting with the semi-spherical shell shaped rocking member 30.

Now, the operation of the embodiment of this invention will be described as the construction of the is further described.

(1) When downward pressure is applied simply on the center of the key top to operate the central switch:

Referring to FIG. 5, as a downward pressure is applied to the key top 2, the central movable contact 54 is pressed down by means of the projection 52 formed on the rubber resilient sheet 5 to be click-inverted into touch with the circular fixed contact whereupon the central switch 430 is turned ON. When the pressure is released, the key top 2 is returned to its original position under the upward biasing force of the key top biasing coil spring 36 as the central movable contact 54 is click-inverted back to turn the central switch 430 is turned OFF.

Figure 10:
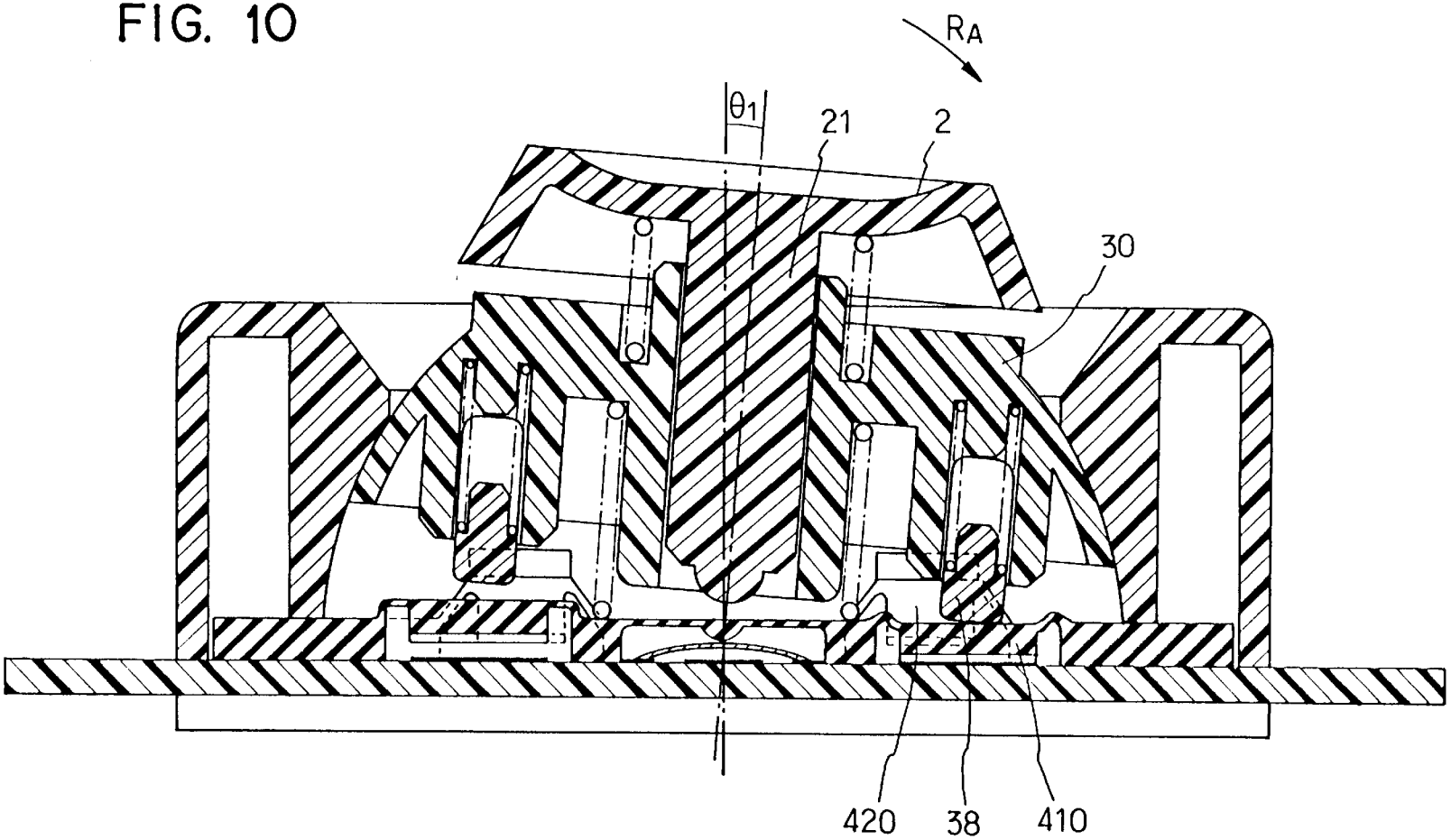
FIG. 10 is a cross-sectional view showing the portion of the key top corresponding to the first stage of switches being depressed.

(2) When downward pressure is applied to the key top on that portion of the periphery thereof corresponding to the first stage switch:

Referring to FIGS. 5 and 6, as a downward pressure is applied to the key top 2 on that portion thereof corresponding to the first stage switch, the operating stick 21 is tilted toward the pressed direction as the semi-spherical shell shaped rocking member 30 is rolled in the direction indicated by the arrow RA. It should be noted here that preferably the center OX of rolling of the key top 2 lies on the center of the central fixed contact 53. Since the lower end of the slide member 38 nearly in contact with the movable roof portion 5A of the resilient sheet 5 when the operating stick 21 is in its neutral position, in the illustrated example the movable contact 51*b* is brought into abutment with the fixed contact 41*b* to turn the first stage switch ON, by the slide member 38 being moved downwardly by rolling of the rocking member 30 by a distance only equivalent to a gap between the undersurface of the movable contact 51*b* and the upper surface of the fixed contact 41*b*. In this state, as shown in FIG. 10, the slide member 38 is in its lowest portion under the resilient force of the spring 39 with the engagement prongs 382 engaged with the shoulders 33S described with reference to FIG. 7A. In this position, the first stage switch 410*a* is press-actuated into the ON position by means of the slide member 38 while the central switch 430 is in its OFF position.

Figure 11:
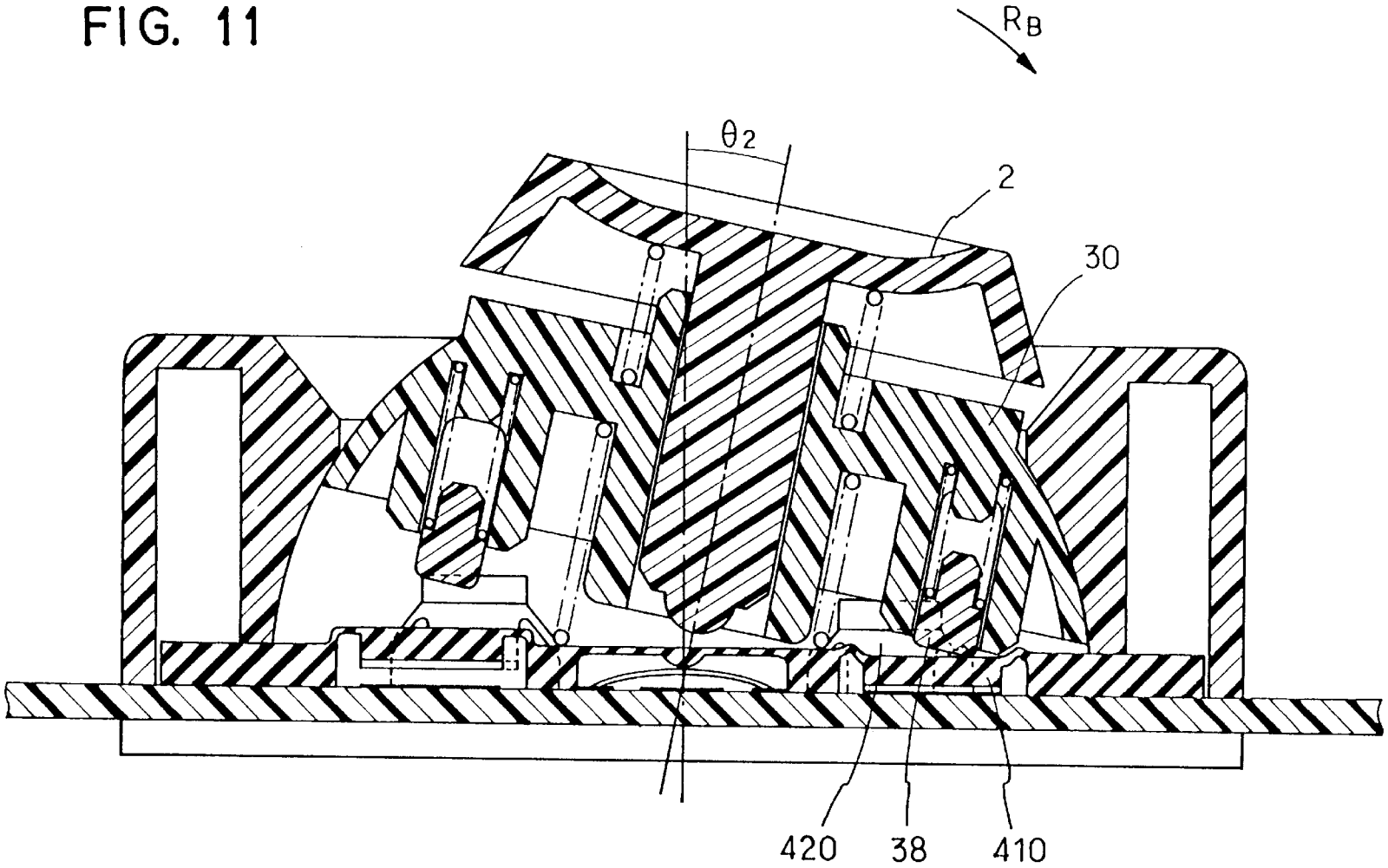
FIG. 11 is a cross-sectional view showing the portion of the key top being depressed further from the position shown in FIG. 10.
Figure 12:
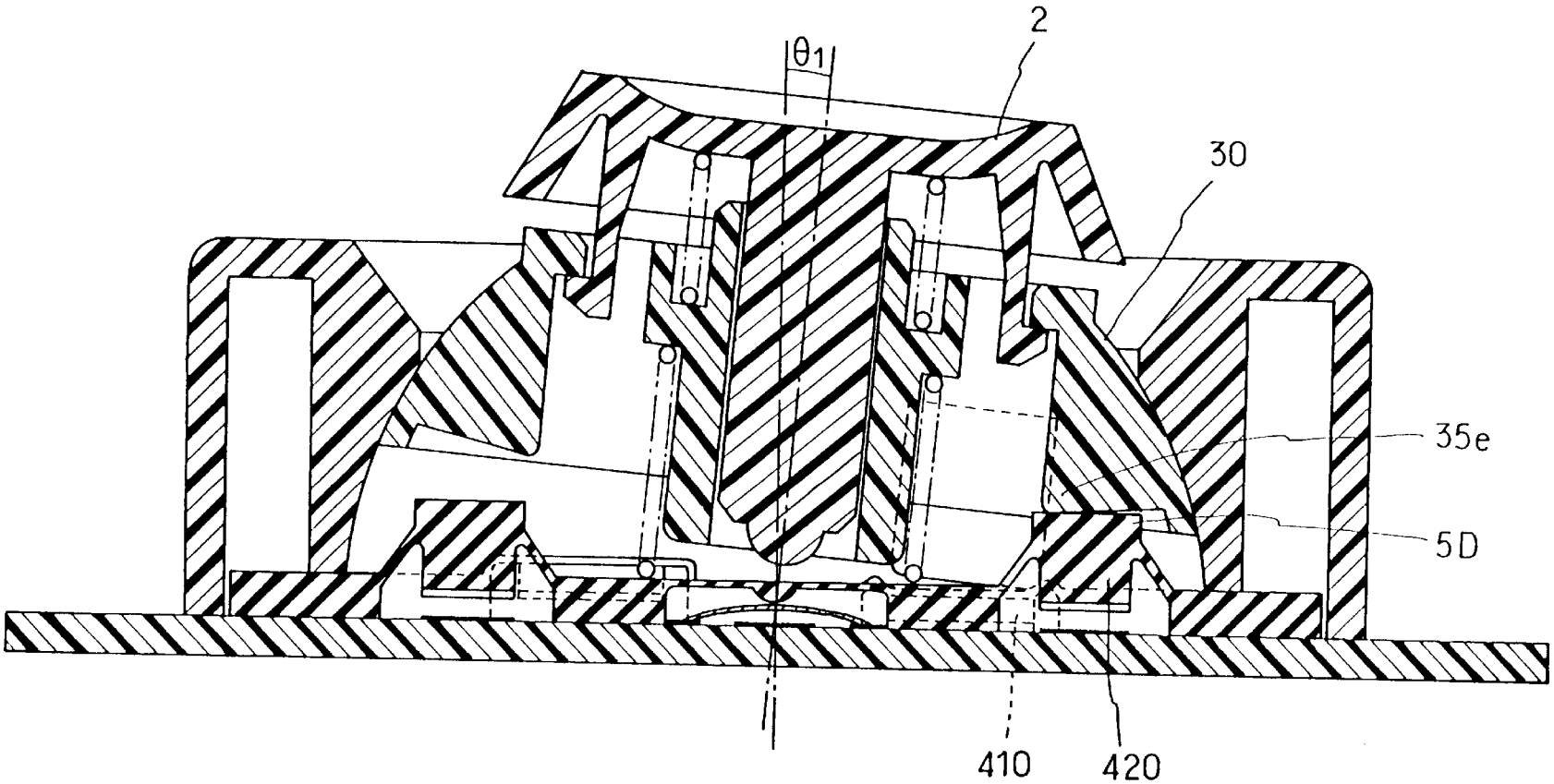
FIG. 12 is a cross-sectional view showing the portion of the key top corresponding to the second stage of switches being depressed.
Figure 13:
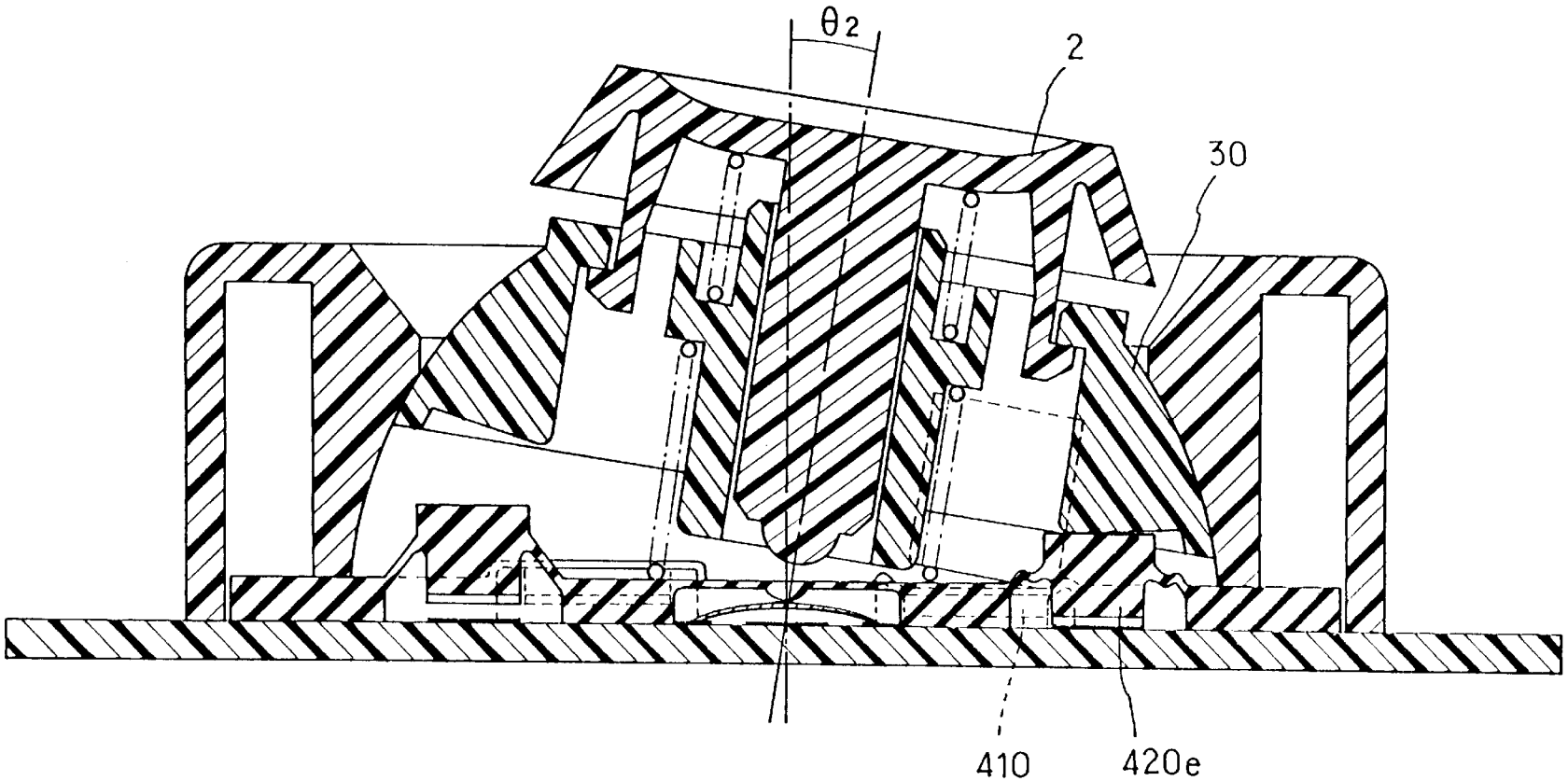
FIG. 13 is a cross-sectional view showing the portion of the key top being further depressed further from the position shown in FIG. 12.

Since the slide member 38 cannot be moved down any more, further pressure applied on the key top 2 will force the slide member 38 into the slide member receiving bores 33 (as shown in FIG. 11), so that the semi-spherical shell shaped rocking member 30 is rolled further in the direction indicated by the arrow RB in FIG. 11 by means of the key top 2 whereupon one or adjacent two of the actuating means 35 come into engagement with associated one or two of the second stage switches 420 to press-actuate it or them into the ON position. This is shown in FIG. 13. It is to be noted that the central switch 430 is in its OFF position.

(3) When downward pressure is applied to the key top on that portion of the periphery thereof corresponding to the second stage switch:

Referring to FIG. 6, as a downward pressure is applied to the key top 2 on that portion thereof corresponding to the second stage switch, the semi-spherical shell shaped rocking member 30 is rolled in the direction indicated by the arrow RB. In this case as well, one or two of the first stage switches located toward the direction in which the operating stick 21 is tilted is or are actuated to the ON position Further rolling the semi-spherical shell shaped rocking member 30 will bring the actuating means 35*e* into abutment with the top surface of the dome 5D (FIG. 12), and still further rolling the rocking member will turn the second stage switch 420*e* ON (FIG. 13). It is noted here that the central switch 430 is in its OFF position.

(4) When that portion of the key top corresponding to either the first stage switch or the second stage switch is pressed down by tilting the operating stick while the center of the key top is maintained in its pressed down position:

By this operation, three kinds of switches, the central switch 430, the first stage switch 410 and the second stage switch 420 may simultaneously be maintained in their ON positions.

The embodiment described above is applicable to a remote control for a car navigation system. In that application, the first stage switches 410*a* to 410*d* may be used to indicate the direction of movement of a cursor within a monitor of the car navigation system. Specifically, when the first stage switch 410*a* is turned ON, it is assumed to indicate the upward direction. When the first stage switch 410*b* is turned ON, it is assumed to indicate the rightward direction. Likewise, when the first stage switch 410*c* is turned ON, it is assumed to indicate the downward direction, and when the first stage switch 410*d* is turned ON, it is assumed to indicate the leftward direction. In this case, energization of the second stage switches 420 may be utilized to increase the speed of movement of the cursor. When the first stage switch 410*a* is turned ON and additionally the second stage switch 420*e* or 420*h* is turned ON, the speed of movement of the cursor in the upward direction is increased. When the first stage switch 410*c* is turned ON and when the second stage switch 420*f* or 420*g* is turned ON, the speed of movement of the cursor in the downward direction is increased. When the first stage switch 410*b* is turned ON and when the second stage switch 420*e* or 420*f* is turned ON, the speed of movement of the cursor in the rightward direction is increased. When the first stage switch 410*d* is turned ON and when the second stage switch 420*g* or 420*h* is turned ON, the speed of movement of the cursor in the leftward direction is increased.

EFFECTS OF THE INVENTION

As discussed above, this invention eliminates the variation in the feeling of operation between first stage switches and second stage switches by disposing both the first stage switches and the second stage switches on the same circle in a printed-circuit board and a rubber resilient sheet forming part of a multi-directional key switch. In addition, this arrangement improves the space factor as well as reducing the number of component parts required, as compared to the prior art arrangement in which first stage switches and second stage switches are formed on separate sheets.

In this invention, the key top biasing coil spring, the semi-spherical shell shaped rocking member biasing coil spring and the slide member stroke producing spring are utilized. It is to be understood that the feeling of operation of the key top may easily be regulated by varying the loading of these springs.

According to this invention, the operator can perceive more clearly that the second stage switch 420 has further been actuated by configuring either one of the first and second stage switched, particularly the second stage switches so as to be ones which may impart the feeling of click to the operator.

What is claimed is:

1. A multi-directional key switch assembly capable of selectively actuating a plurality of switches, said assembly comprising:

a substrate board having disposed thereon first fixed contacts and second fixed contacts for a plurality of first stage switches and a plurality of second stage switches of a different kind, and having a different type of actuation than that of said first stage switches, said first fixed contacts and second fixed contacts being alternately arrayed on a common circle;

first and second roof portions disposed over the first and second fixed contacts, each of said first and second roof portions having a circumference elastically supported on said substrate board;

first and second movable contacts attached to undersides of said first and second roof portions in opposition to said corresponding first and second fixed contacts and being cooperative with the first and second fixed contacts to define said first stage and second stage switches, respectively;

a rolling means having first and second actuating means disposed in overlying relation to said first and second movable contacts, respectively, said first and second actuating means being operative in response to external forces applied in a desired direction about the center of said common circle to actuate corresponding one or more of said first stage and second stage switches; and a key top mounted on said rolling means and adapted in response to external forces applied to said key top to roll said rolling means, whereby rolling said rolling means in any desired direction will cause the corresponding first stage switch or switches to be turned ON, and further continued rolling of said rolling means in the same direction will actuate the corresponding second switch or switches to turn it or them ON;

said first actuating means including slide members disposed over said first movable roof portions, respectively, slide member receiving bores formed in said rolling member for receiving the slide members slidably in a direction parallel to a central axis of said rolling means, and stroke producing springs for imparting, to the corresponding slide members, a biasing force to push the slide members against said first movable roof portions away from said slide member receiving bores; and said second actuating means including engaging protrusions protruding from said rolling member for actuating said second movable roof portions.

2. The multi-directional key switch assembly of claim 1 further including a central fixed contact disposed on said board means in the center of said common circle, and a central movable contact disposed in opposition to said central fixed contact, wherein said rolling means has a receiving bore extending therethrough along the central axis thereof, and said key top has an operating stick extending from the undersurface thereof through said receiving bore and adapted to actuate said central movable contact and/or roll said rolling means.

3. The multi-directional key switch assembly of claim 2 further including a key top biasing spring disposed between said key top and said rolling means for imparting a biasing force to urge said key top away from said rolling means, said key top having extending downwardly from the undersurface thereof at least one integral engagement piece which is in engagement with an engagement hole formed in said rolling means to prevent dislodgement of the key top from said receiving bore.

4. The multi-directional key switch assembly of claim 3, wherein said rolling means includes a generally truncated semi-spherical shell shaped rolling member having a generally truncated semi-spherical outer peripheral surface, and a housing accommodating said rolling member and having a generally truncated semi-spherical inner slide wall surface slidably contacting said generally truncated semi-spherical outer peripheral surface of the rolling member, said housing having an opening in its top end to expose the top surface of said rolling member to the exterior, said key top protruding from said opening.

5. The multi-directional key switch assembly of claim 4, wherein each of said fixed contacts comprises a pair of interdigiting comb-like electrodes.

6. The multi-directional key switch assembly of claim 4, wherein said substrate board includes a printed-circuit board having formed thereon said first and second fixed contacts, and a rubber resilient sheet overlying the upper surface of said printed-circuit board, said rubber resilient sheet being formed on its undersurface with recesses corresponding to said respective fixed contacts, those portions of said rubber resilient sheet forming the upper walls of said recesses constituting movable roof portions on the undersurfaces of which said corresponding movable contacts are formed, said rolling means being disposed above said rubber resilient sheet.

7. The multi-directional key switch assembly of claim 6, wherein said generally truncated semi-spherical shell shaped rolling member has an integral cylindrical sleeve portion extending downwardly from the undersurface thereof, said receiving bore for receiving said operating stick being formed through said cylindrical sleeve portion, and there is provided a rolling member biasing spring disposed between the undersurface of said rolling member around said cylindrical sleeve portion and said rubber resilient sheet for imparting a biasing force to always urge said rolling member into contact with said housing.

8. The multi-directional key switch assembly of claim 7, wherein the biasing force of said rolling member biasing spring is greater than the biasing force of said key top biasing spring.

9. The multi-directional key switch assembly of claim 4, wherein said slide members each comprise an engagement portion engageable in the corresponding slide member receiving bore to prevent dislodgement of the slide member from the receiving bore.

10. The multi-directional key switch assembly of claim 4, further including a rubber resilient sheet having formed integrally therewith frusto-conical domes for enclosing the respective second fixed contacts, said domes each having a thickened movable roof portion surrounded by a thinned peripheral wall, said second movable roof portions of said domes having corresponding said second movable contacts formed in the undersurfaces thereof, said second actuating means being adapted to press down on the upper surfaces of the movable roof portions of said domes.

11. The multi-directional key switch assembly of claim 4, wherein a tilt angle $\theta_2$ required of the operating stick to turn ON each of said second stage switches is greater than a tilt angle $\theta_1$ required of the operating stick to turn On each of said first stage switches.

12. The multi-directional key switch assembly of claim 4, wherein four each of said first and second fixed contacts are provided and arrayed on said common circle at equal angular intervals.

13. The multi-directional key switch assembly of claim 4, wherein said central fixed contact comprises a C-shaped outer electrode and a circular electrode disposed within said outer electrode.

14. The multi-directional key switch assembly of claim 13, wherein said central movable contact is a snap plate formed of a thin resilient metallic material having an upwardly convex spherical surface and resting on said C-shaped outer electrode.

* * * * *